US009914299B2

(12) United States Patent
Arai et al.

(10) Patent No.: US 9,914,299 B2
(45) Date of Patent: Mar. 13, 2018

(54) INKJET HEAD AND INKJET RECORDING APPARATUS

(71) Applicant: TOSHIBA TEC KABUSHIKI KAISHA, Tokyo (JP)

(72) Inventors: Ryuichi Arai, Numazu Shizuoka (JP); Ryutaro Kusunoki, Mishima Shizuoka (JP); Shuhei Yokoyama, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 13 days.

(21) Appl. No.: 15/047,668

(22) Filed: Feb. 19, 2016

(65) Prior Publication Data

US 2016/0279933 A1 Sep. 29, 2016

(30) Foreign Application Priority Data

Mar. 23, 2015 (JP) ..... 2015-059703

(51) Int. Cl.
*B41J 2/16* (2006.01)
*B41J 2/14* (2006.01)

(52) U.S. Cl.
CPC .... *B41J 2/14233* (2013.01); *B41J 2002/1437* (2013.01); *B41J 2002/14491* (2013.01); *B41J 2202/15* (2013.01)

(58) Field of Classification Search
None
See application file for complete search history.

(56) References Cited

U.S. PATENT DOCUMENTS

| | | | | |
|---|---|---|---|---|
| 8,608,296 | B2 * | 12/2013 | Nakatani | B41J 2/14233 347/70 |
| 8,807,712 | B2 | 8/2014 | Nakatani | |
| 8,876,262 | B2 | 11/2014 | Arai et al. | |
| 8,939,554 | B2 | 1/2015 | Nagahata | |
| 2012/0280165 | A1 * | 11/2012 | Harigai | C23C 14/0021 252/62.9 PZ |
| 2014/0071204 | A1 * | 3/2014 | Kusunoki | B41J 2/14233 347/50 |
| 2014/0292859 | A1 * | 10/2014 | Aruga | B41J 2/04501 347/12 |

* cited by examiner

*Primary Examiner* — Matthew Luu
*Assistant Examiner* — Tracey McMillion
(74) *Attorney, Agent, or Firm* — Patterson & Sheridan, LLP

(57) ABSTRACT

According to an embodiment, an inkjet head includes nozzles. The nozzles are arranged on a nozzle plate. The inkjet head further includes actuators arranged corresponding to the nozzles one to one on the nozzle plate. The inkjet head further includes common electrodes and individual electrodes that apply voltage to the actuators. A connection terminal of the common electrode is arranged between connection terminals of the individual electrode.

15 Claims, 4 Drawing Sheets

INKJET HEAD AND INKJET RECORDING APPARATUS

CROSS-REFERENCE TO RELATED APPLICATIONS

This application is based upon and claims the benefit of priority from the prior Japanese Patent Application No. 2015-059703, filed on Mar. 23, 2015, the entire contents of which are incorporated herein by reference.

FIELD

Embodiments described here generally relate to an inkjet head and an inkjet recording apparatus.

BACKGROUND

An on-demand inkjet recording system ejects ink drops from a nozzle in accordance with an image signal, and forms an image on the recording paper with the ink drops. The on-demand inkjet recording system includes those of a heating element type and a piezoelectric element type.

In the heating element type system, a heating element in ink flow paths generates air bubbles in ink. The ink drops pushed by the air bubbles are ejected from a nozzle. On the other hand, in the piezoelectric element, a piezoelectric element being an actuator deforms, and the pressure of ink stored in ink cells is thereby changed. As a result, the pressurized ink drops are ejected from the nozzle.

An example of the piezoelectric element inkjet head includes nozzles and driving elements (actuators) corresponding to each other one to one. The actuators each include a piezoelectric element, and a common electrode and an individual electrode that apply voltage to the piezoelectric element. The common electrode and the individual electrode are each electrically connected to a driving circuit via a conductor pattern. When drive voltage is applied to the piezoelectric element from the driving circuit via the common electrode and the individual electrode, the piezoelectric element deforms. As a result, the ink supplied to the pressure cell is pressurized. Part of the pressurized ink forms ink drops, and the ink drops are ejected from a nozzle.

In an inkjet head including many driving elements (actuators), if the inkjet has a structure including the common electrode described above, a connection terminal that connects the common electrode and an external terminal for applying voltage is arranged only at the end of the head body. In such a structure, the maximum distance between the connection terminal of the common electrode and the driving elements increases as the size of the head body increases. For that reason, the voltage is changed due to wiring resistance, and it may affect driving of each driving element.

In addition, if the difference between the maximum distance and the minimum distance between the connection terminal of the common electrode and the driving elements is large, the difference between voltage changes in the driving elements is large and the stability of the driving of each driving element may be reduced. Further, in the case where the connection terminal of the common electrode is arranged only at the end of the head body, current concentration occurs, and thus a problem such as short-circuiting and wiring damage may occur.

DETAILED DESCRIPTION

Figure 1:
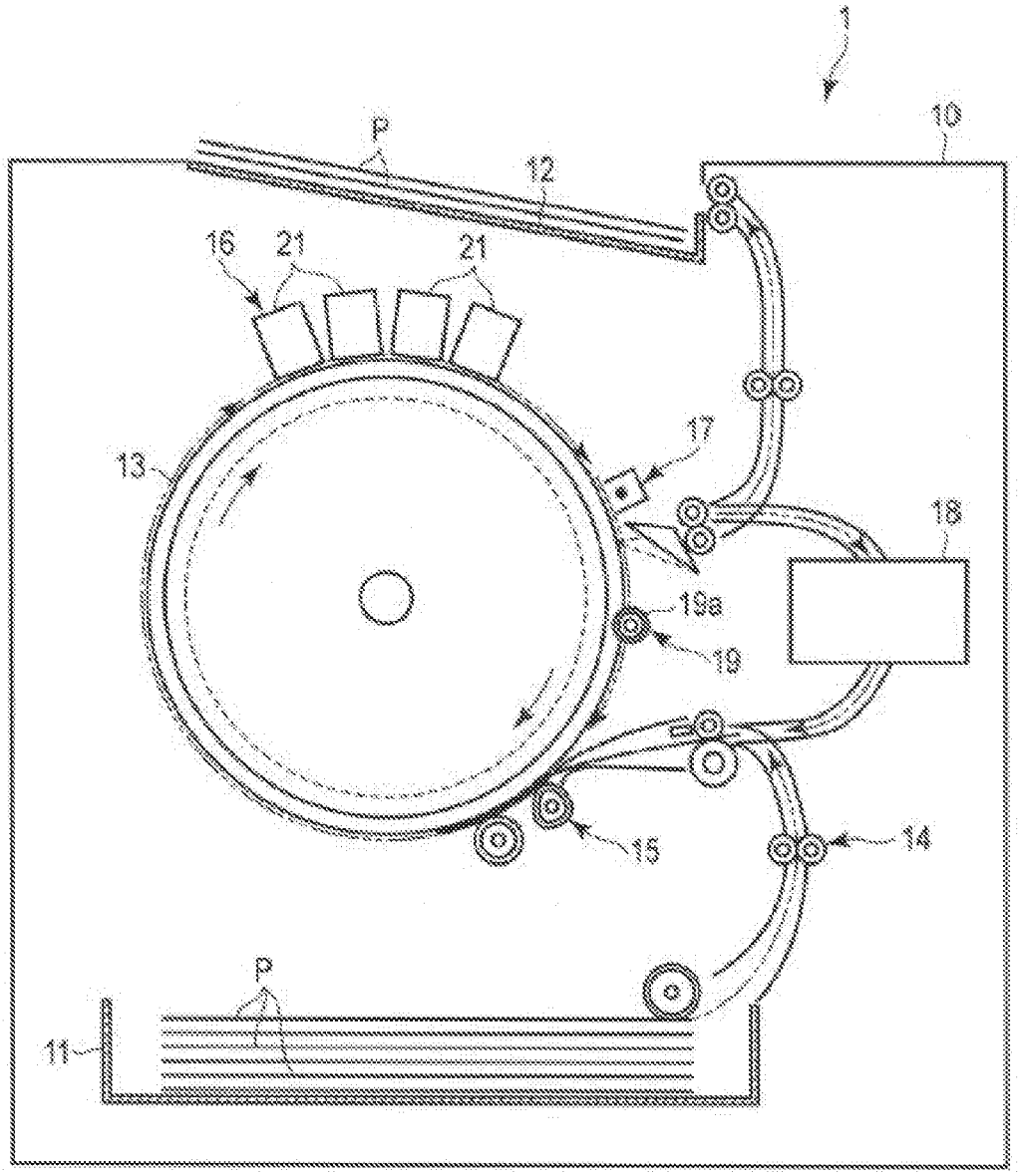
FIG. 1 is a longitudinal sectional view schematically showing the whole structure of an inkjet printer of an embodiment.

According to one embodiment, an inkjet head includes nozzles, a nozzle plate, actuators, individual electrodes, a common electrode. Each of the nozzles ejects ink. The nozzles are arranged on the nozzle plate. The actuators are arranged corresponding to the nozzles one to one on the nozzle plate. The individual electrodes are arranged on the nozzle plate, each of the individual electrodes including a connection terminal connected to an external element, each of the individual electrodes applying voltage to the corresponding actuator. The common electrode is arranged on the nozzle plate, the common electrode applying voltage to the actuators, the common electrode including a connection terminal connected to the external element, the connection terminal being arranged between the connection terminals of the individual electrodes.

Hereinafter, an embodiment will be described with reference to FIG. 1 to FIG. 4. Note that each element, which can be expressed by some terms, may sometimes be expressed by another term or other terms. However, it does not mean that any element, which is only expressed by a single term, is never expressed by another term or other terms. In addition, it does not mean that another term or other terms, which is/are not exemplified, is/are never used to express each element. In addition, the figures show this embodiment schematically. The sizes shown in the figures may sometimes be different from those described in this embodiment. In addition, in the drawings, the same reference symbols show the same or similar parts.

FIG. 1 is a longitudinal sectional view schematically showing the whole structure of an inkjet printer 1 of an embodiment. The inkjet printer 1 is an example of an inkjet recording apparatus. Note that an inkjet recording apparatus may be another apparatus such as a copy machine instead of the inkjet printer.

As shown in FIG. 1, the inkjet printer 1 conveys recording paper P, for example, as a recording medium, and at the same time, performs various processes such as image forming. The inkjet printer 1 includes a housing 10, a paper cassette 11, a copy receiving tray 12, s holding roller (drum) 13, a conveyer apparatus 14, a holding apparatus 15, an image forming apparatus 16, a static-eliminating and peeling apparatus 17, an inversing apparatus 18, and a cleaning apparatus 19.

The paper cassette 11 stores a plurality of sheets of recording paper P, and is arranged in the housing 10. The copy receiving tray 12 is arranged at the top of the housing 10. The inkjet printer 1 forms an image on recording paper P, and discharges the recording paper P to the copy receiving tray 12.

The conveyer apparatus 14 includes guides and conveyer rollers arranged along the path on which the recording paper P is conveyed. The conveyer roller is driven by a motor, rotates, and thus conveys the recording paper P from the paper cassette 11 to the copy receiving tray 12.

The holding roller 13 includes a cylindrical frame made of a conductor, and a thin insulation layer formed on the surface of the frame. The frame is grounded. The holding roller 13 rotates where it holds the recording paper P on its surface, and thus conveys the recording paper P.

The holding apparatus 15 presses the recording paper P, which is discharged from the paper cassette 11 by the conveyer apparatus 14, on the surface (outer surface) of the holding roller 13. The holding apparatus 15 presses the recording paper P on the holding roller 13, and then attaches the recording paper P to the holding roller 13 by an electrostatic force of the electrostatically-charged recording paper P. The holding roller 13 holds the recording paper P where the recording paper P is attached to the holding roller 13. The holding roller 13 rotates, and thereby conveys the held recording paper P.

The image forming apparatus 16 forms an image on the recording paper P on the outer surface of the holding roller 13, the recording paper P being held by the holding apparatus 15. The image forming apparatus 16 includes inkjet heads 21, which face the surface of the holding roller 13. The inkjet heads 21 eject four-color inks (for example, cyan, magenta, yellow, and black) toward the recording paper P, and thereby form an image on the recording paper P.

The static-eliminating and peeling apparatus 17 eliminates static electricity from the recording paper P, on which the image is formed, and thereby peels the recording paper P from the holding roller 13. Specifically, the static-eliminating and peeling apparatus 17 electrically charges the recording paper P, and thereby eliminates static electricity from the recording paper P. Further, the static-eliminating and peeling apparatus 17 includes a peeling nail (not shown), and inserts the peeling nail between the static-eliminated recording paper P and the holding roller 13. As a result, the recording paper P is peeled from the holding roller 13. The conveyer apparatus 14 conveys the recording paper P, which is peeled from the holding roller 13, to the copy receiving tray 12 or the inversing apparatus 18.

The cleaning apparatus 19 cleans the holding roller 13 from which the recording paper P has been peeled. The cleaning apparatus 19 is arranged at the downstream of the static-eliminating and peeling apparatus 17 in the rotational direction of the holding roller 13. The cleaning apparatus 19 includes a cleaning member 19*a*. The cleaning apparatus 19 causes the cleaning member 19*a* to come into close contact with the surface of the rotating holding roller 13, and thereby cleans the surface of the rotating holding roller 13.

In order to form images on the two sides of the recording paper P, the inversing apparatus 18 turns the recording paper P, which is peeled from the holding roller 13, upside down, and supplies the recording paper P to the surface of the holding roller 13 again. Specifically, the conveyer apparatus 14 switches back the peeled recording paper P the other way around, and thereby conveys the recording paper P to the inversing apparatus 18. The inversing apparatus 18 includes a predetermined inversion path. The inversing apparatus 18 conveys the recording paper P along the inversion path, and thereby turns the recording paper P upside down.

Figure 2:
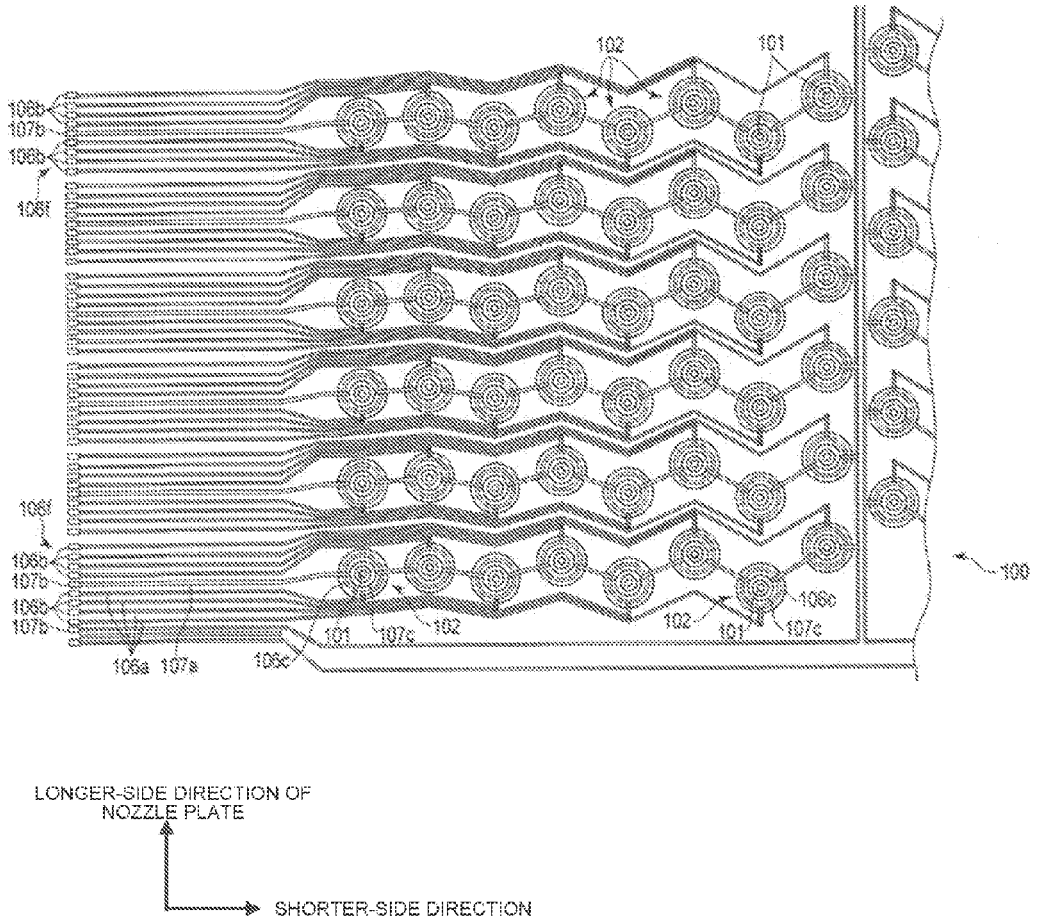
FIG. 2 is a plan view showing the structure of the main part of an inkjet head of the embodiment.
Figure 3:
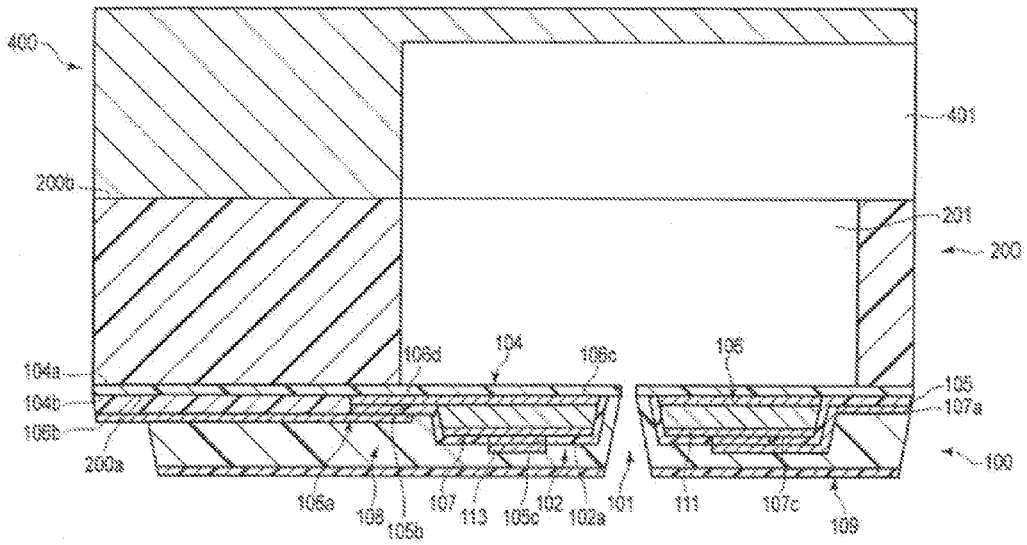
FIG. 3 is a longitudinal sectional view showing the main part of how an electrode part of an individual electrode and a connection terminal of the individual electrode in the inkjet head of the embodiment are connected to each other.
Figure 4:
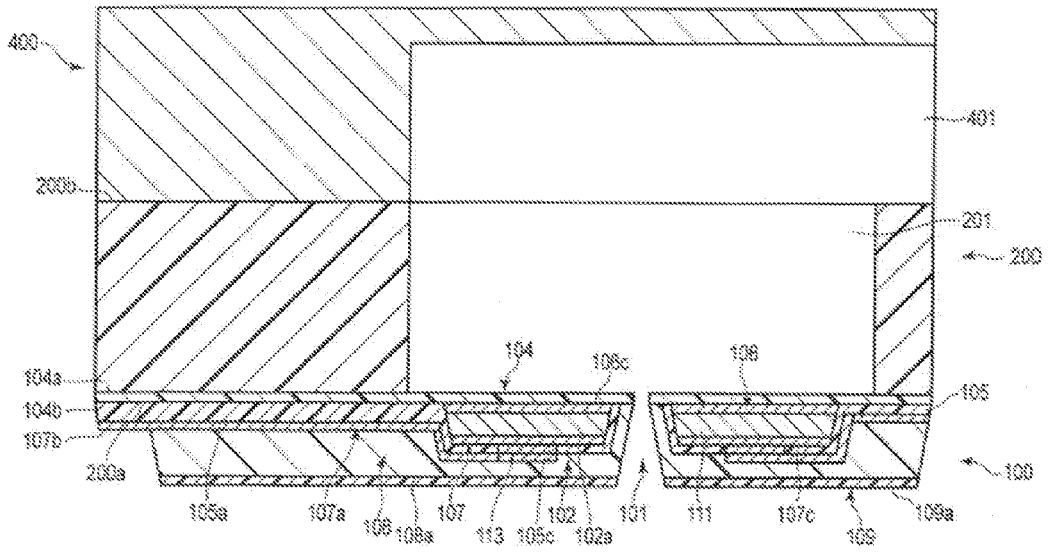
FIG. 4 is a longitudinal sectional view showing the main part of how an electrode part of a common electrode and a connection terminal of the common electrode in the inkjet head of the embodiment are connected to each other.

FIG. 2 is a plan view showing the structure of the main part of the inkjet heads 21. FIG. 3 is a longitudinal sectional view showing the main part of how an electrode part (electrode part 106*c*) of an individual electrode (lower electrode 106) and a connection terminal (connection terminal part 106*b*) of the individual electrode (lower electrode 106) in the inkjet heads 21 of the embodiment are connected to each other. FIG. 4 is a longitudinal sectional view showing the main part of how an electrode part (electrode part 107*c*) of a common electrode (upper electrode 107) and a connection terminal (connection terminal part 107*b*) of the common electrode (upper electrode 107) in the inkjet heads 21 of the embodiment are connected to each other. Note that, for illustrative purposes, FIGS. 2, 3 and 4 show various elements, which are actually hidden, in solid lines.

The inkjet printer 1 includes ink tanks and ink controllers (not shown), which are connected to each of the inkjet heads 21. Each inkjet head 21 is connected to the ink tanks, which store ink of the corresponding color.

The inkjet head 21 ejects ink drops toward the recording paper P held by the holding roller 13, and thereby forms texts and images thereon. As shown in FIGS. 3 and 4, the inkjet head 21 includes a nozzle plate 100, a pressure cell structure 200, and an ink flow path structure 400. The pressure cell structure 200 is an example of the substrate.

The nozzle plate 100 has a rectangular plate shape. The nozzle plate 100 is formed on the pressure cell structure 200, the nozzle plate 100 and the pressure cell structure 200 being an assembly. The nozzle plate 100 includes nozzles (orifices, ink ejecting holes) 101 and driving elements (piezoelectric elements, actuators) 102.

The nozzles 101 are circular holes. The diameter of the nozzle 101 is, for example, 20 μm. As shown in FIG. 2, the nozzles 101 are arrayed in the longer-side direction (vertical direction of FIG. 2) and the shorter-side direction (horizontal direction of FIG. 2) of the nozzle plate 100. The nozzles 101 are arranged such that the nozzles 101 in one line are spaced apart from the nozzles 101 in the next line in the longer-side direction of the nozzle plate 100. According to this structure, the driving elements 102 are arranged in a higher density. Note that the longer-side direction of the nozzle plate 100 corresponds to the conveying direction of the recording paper P by the holding roller 13, and the shorter-side direction of the nozzle plate 100 corresponds to the direction perpendicular to the conveying direction of the recording paper P.

The distance between the center of one nozzle 101 and the center of the next nozzle 101, the nozzles 101 being adjacent to each other in the longer-side direction (vertical direction of FIG. 2) of the nozzle plate 100, is 340 μm, for example. The distance between the center of one line of the nozzles 101 and the center of the next line of the nozzles 101, the lines being adjacent to each other in the shorter-side direction (horizontal direction of FIG. 2) of the nozzle plate 100, is 240 μm, for example.

The driving elements 102 are arranged corresponding to the nozzles 101 one to one. As shown in FIG. 2, the driving element 102 and the corresponding nozzle 101 are arranged coaxially. The driving element 102 has an annular shape, and surrounds the corresponding nozzle 101. Alternatively, the driving element 102 may have a semi-open annular shape (C shape), for example.

The pressure cell structure 200 is made of a silicon wafer, and has a rectangular plate shape. Alternatively, the pressure cell structure 200 may be another semiconductor such as a silicon carbide (SiC) substrate and a germanium substrate, for example. Alternatively, the substrate may be made of another material such as ceramics, glass, quartz, resin, and metal. Ceramics such as nitride, carbide, and oxide such as alumina ceramics, zirconia, silicon carbide, silicon nitride, and barium titanate is used. Resin such as a plastic material such as ABS (acrylonitrile butadiene styrene), polyacetal, polyamide, polycarbonate, and polyethersulfone is used. Metal such as aluminum and titanium is used. The thickness of the pressure cell structure 200 is, for example, 725 μm.

The thickness of the pressure cell structure 200 is, for example, in the range of 100 to 775 μm.

As shown in FIGS. 3 and 4, the pressure cell structure 200 includes a first surface 200*a*, a second surface 200*b*, and pressure cells (ink cells) 201. The first and second surfaces 200*a* and 200*b* are flat. The second surface 200*b* is opposite to the first surface 200*a*. The nozzle plate 100 is fixed to the first surface 200*a*.

The pressure cells 201 are circular holes. The diameter of the pressure cell 201 is, for example, 190 μm. Note that the shape of the pressure cell 201 is not limited to this. The pressure cell 201 penetrates through the pressure cell structure 200 in its thickness direction, and has an opening through the first surface 200*a* and an opening through the second surface 200*b*. The nozzle plate 100 covers the openings through the first surface 200*a* of the pressure cells 201.

The pressure cells 201 are arranged corresponding to the nozzles 101 one to one. In other words, the pressure cell 201 and the corresponding nozzle 101 are arranged coaxially. According to this structure, the pressure cell 201 is in communication with the corresponding nozzle 101. The pressure cell 201 is in communication with the outside of the inkjet head 21 via the nozzle 101.

The ink flow path structure 400 is made of, for example, stainless steel, and has a rectangular plate shape. The thickness of the ink flow path structure 400 is, for example, 4 mm. Note that the ink flow path structure 400 may be made of any other material such as ceramics and resin. Ceramics such as nitride, carbide, and oxide such as alumina ceramics, zirconia, silicon carbide, and silicon nitride is used. Resin such as a plastic material such as ABS, polyacetal, polyamide, polycarbonate, and polyethersulfone is used. The material of the ink flow path structure 400 is selected so that the pressure is not increased to eject the ink, in consideration of the difference between the expansion coefficient of the ink flow path structure 400 and the expansion coefficient of the nozzle plate 100.

The ink flow path structure 400 is bonded to the pressure cell structure 200 with, for example, epoxy-based adhesive. The ink flow path structure 400 includes ink flow paths 401, an ink inlet port (not shown), and an ink outlet port (not shown).

The ink flow paths 401 are grooves on the ink flow path structure 400. The depth of the ink flow path 401 is, for example, 2 mm. The ink inlet port is an opening at one end of the ink flow path. The ink inlet port is connected to the ink tank via a tube, for example. The ink tank is connected to the pressure cells 201 via the ink flow paths 401.

The ink in the ink tank flows into the ink flow paths 401 through the ink inlet port. The ink supplied to the ink flow paths 401 is supplied to the pressure cells 201. The ink filled in the pressure cells 201 flows also into the nozzles 101 via the openings of the pressure cells 201. The inkjet printer 1 maintains the pressure of the ink at an appropriate negative level, and the ink is thereby kept in the nozzles 101. The ink forms a meniscus on the nozzle 101, and is kept such that the ink may not leak from the nozzle 101.

The ink outlet port is an opening at the other end of the ink flow path 401. The ink outlet port is connected to the ink tank via a tube, for example. The ink in the ink flow paths 401, which has not flowed into the pressure cells 201, is discharged to the ink tank through the ink outlet port. As described above, the ink circulates in the ink tank and the ink flow paths 401. Because the ink circulates, the temperature of the inkjet head 21 and the temperature of the ink are kept constant, and the quality of the ink, which is affected by heat, is less changed, for example.

Next, the nozzle plate 100 will be described in detail. As shown in FIGS. 3 and 4, the nozzle plate 100 includes the nozzles 101, the driving elements 102, a vibration plate 104, an insulation film 105, a lower electrode 106, an upper electrode 107, a protective film 108, and an ink-repellent film 109. The insulation film 105 and the protective film 108 are each an example of an insulator.

The vibration plate 104 is, for example, an $SiO_2$ (silicon dioxide) film formed on the first surface 200*a* of the pressure cell structure 200, and has a rectangular plate shape. In other words, the vibration plate 104 is an oxide film of the pressure cell structure 200, which is a silicon wafer. The vibration plate 104 may be made of another material such as single-crystal Si (silicon), $Al_2O_3$ (aluminum oxide), $HfO_2$ (hafnium oxide), $ZrO_2$ (zirconium oxide), and DLC (Diamond Like Carbon). The thickness of the vibration plate 104 is, for example, 4 μm. The thickness of the vibration plate 104 is in the range of 1 to 50 μm, approximately.

The vibration plate 104 includes a first surface 104*a* and a second surface 104*b*. The first surface 104*a* is fixed to the pressure cell structure 200, and covers the pressure cell 201. The second surface 104*b* is opposite to the first surface 104*a*.

The lower electrode 106 is formed on the second surface 104*b* of the vibration plate 104. As shown in FIGS. 2 and 3, the lower electrode 106 includes wiring parts 106*a* (wiring patterns), connection terminal parts 106*b*, electrode parts 106*c* that come into contact with the piezoelectric film 111, and parallel arrangement parts 106*f*. The connection terminal parts 106*b* of the lower electrode 106 are each located at one end of the shorter-side direction of the vibration plate 104 (i.e., shorter-side direction of the nozzle plate 100). The parallel arrangement part 106*f* includes the connection terminal parts 106*b* arranged at the end of the nozzle plate 100 in parallel. The parallel arrangement parts 106*f* are arrayed at the end of the nozzle plate 100 along the longer-side direction of the vibration plate 104 (longer-side direction of the nozzle plate 100).

As shown in FIGS. 2 and 4, the upper electrode 107 includes a wiring part 107*a* (wiring pattern), a connection terminal part 107*b*, and an electrode part 107*c* that comes into contact with the piezoelectric film 111. The connection terminal part 107*b* is located at one end of the shorter-side direction of the vibration plate 104 (shorter-side direction of the nozzle plate 100). As shown in FIG. 2, the connection terminal part 107*b* is arranged between the connection terminal parts 106*b*. Further, the connection terminal part 107*b* is arranged at the outside part of the parallel arrangement part 106*f*. In addition, the connection terminal part 107*b* is arranged between the parallel arrangement parts 106*f* arranged along the longer-side direction of the vibration plate 104 (longer-side direction of the nozzle plate 100). Further, the connection terminal part 107*b* is located at both ends of the parallel arrangement part 106*f*.

The lower electrode 106 is a thin film made of, for example, Pt (platinum) and Al (aluminum). The wiring part 107*a* and the connection terminal part 107*b* of the upper electrode 107 are each a thin film made of Ti (titanium) and Al. Note that the lower electrode 106 and the upper electrode 107 may be made of another material such as Ni (nickel), Cu (copper), Al (aluminum), Ag (silver) Ti (titanium), W (tungsten), Mo (molybdenum), and Au (gold).

The thickness of the lower electrode 106 and the upper electrode 107 is, for example, 0.5 μm. The film thickness of the lower electrode 106 and the upper electrode 107 is in the range of 0.01 μm to 1 μm, approximately. The width of the wiring part 106*a* of the lower electrode 106 and the wiring part 107*a* of the upper electrode 107 is, for example, 10 μm.

As shown in FIGS. 3 and 4, the driving elements 102 each include the electrode part 106*c* that comes into contact with the piezoelectric film 111, the piezoelectric film 111, and the electrode part 107*c* that comes into contact with the piezoelectric film 111. The driving element 102 is arranged on the second surface 104*b* of the vibration plate 104. The driving element 102 applies the pressure for causing the corresponding nozzle 101 to eject ink drops to the ink in the corresponding pressure cell 201.

The electrode part 106*c* that comes into contact with the piezoelectric film 111 of the lower electrode 106 is arranged on the second surface 104*b* of the vibration plate 104. The electrode part 106*c* surrounds the nozzle 101 and has an annular shape. The electrode part 106*c* and the nozzle 101 are arranged coaxially. The outer diameter of the electrode part 106*c* is, for example, 133 μm. The inner diameter of the electrode part 106*c* is, for example, 30 μm. According to this structure, as shown in FIG. 3, the electrode part 106*c* includes a part 106*d* that is arranged separately from the nozzle 101 and does not come into contact with the piezoelectric film 111. The electrode part 106*c* comes into contact with the wiring part 106*a* at the part 106*d*, and conduction between them is thereby ensured.

The wiring part 106*a* of the lower electrode 106 connects the electrode part 106*c* and the connection terminal part 106*b* of the corresponding driving elements 102. The wiring part 106*a* is arranged between the driving elements 102 in the shorter-side direction of the nozzle plate 100 (e.g., horizontal direction of FIG. 2), the driving elements 102 being adjacent to each other in the longer-side direction of the nozzle plate 100 (e.g., vertical direction of FIG. 2).

As shown in FIGS. 3 and 4, the piezoelectric film 111 surrounds the nozzle 101, and has the same size as the electrode part 106*c* of the lower electrode 106 and an annular shape. The piezoelectric film 111 is slightly smaller than the electrode part 106*c*. Alternatively, the piezoelectric film 111 may be larger than the electrode part 106*c*. The piezoelectric film 111 and the nozzle 101 are arranged coaxially. The piezoelectric film 111 covers the electrode part 106*c*.

The piezoelectric film 111 is a film made of lead zirconium titanate (PZT) being a piezoelectric material. Alternatively, the piezoelectric film 111 may be made of any one of various piezoelectric materials such as PTO ($PbTiO_3$: lead titanate), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, and AlN.

The thickness of the piezoelectric film 111 is, for example, 2 μm. The thickness of the piezoelectric film 111 is determined based on its piezoelectric property, dielectric breakdown voltage, and the like. The thickness of the piezoelectric film 111 is in the range of 0.1 μm to 5 μm, approximately.

The piezoelectric film 111 is polarized in the thickness direction (e.g., vertical direction of FIG. 3) at the time when the film is formed. In other words, for example, the piezoelectric film 111 is polarized, the side on the electrode part 106*c* being positive, the side of the piezoelectric film 111 on the electrode part 107*c* being negative. Drive voltage is applied to the electrode part 106*c* of the lower electrode 106 and the electrode part 107*c* of the upper electrode 107. When the drive voltage is applied, the electric field in the thickness direction of the piezoelectric film 111 is applied to the polarized piezoelectric film 111. At this time, the piezoelectric film 111 expands or contracts in the electric field direction (thickness direction of the piezoelectric film 111), and contracts or expands in the direction (in-plane direction of the piezoelectric film 111) perpendicular to the electric field direction, at the same time. As a result, the driving element 102, which includes the piezoelectric film 111, expands or contracts in the electric field direction and contracts or expands in the direction perpendicular to the electric field direction, at the same time.

As the piezoelectric film 111, ferroelectric such as PZT is used. Note that if a strong electric field is applied to the piezoelectric film 111, the polarization of the piezoelectric film 111 at the time when the film is formed is inverted. Because of this, the electric field in the range in which the polarization is not inverted is applied to the piezoelectric film 111. As a result, the piezoelectric film 111 expands or contracts as described above.

The electrode part 107*c* of the upper electrode 107 surrounds the nozzle 101, and has the same size as the electrode part 106*c* of the lower electrode 106 and the piezoelectric film 111 and an annular shape. The electrode part 107*c* is slightly smaller than the piezoelectric film 111. Alternatively, the electrode part 107*c* may be larger than the piezoelectric film 111. The electrode part 107*c* and the nozzle 101 are arranged coaxially. The electrode part 107*c* covers the piezoelectric film 111. In other words, the electrode part 107*c* is provided on the ejection side of the piezoelectric film 111 (external side of the inkjet head 21)

The piezoelectric film 111 is interposed between the electrode part 106*c* of the lower electrode 106 and the electrode part 107*c* of the upper electrode 107. In other words, the electrode part 106*c* and the electrode part 107*c* are arranged to be overlapped on both sides of the piezoelectric film 111. The piezoelectric film 111 insulates the electrode part 106*c* and the electrode part 107*c* from each other. The electrode part 107*c* faces the electrode part 106*c* via the piezoelectric film 111.

The electrode part 107*c* of the upper electrode 107 constitutes the outer surface 102*a* of the driving element 102. The outer surface 102*a* is one surface of the driving element 102 that faces the opposition side of the vibration plate 104. In other words, the outer surface 102*a* faces the ejection side of the driving element 102. The outer surface 102*a* is a surface approximately parallel to the second surface 104*b* of the vibration plate 104.

The insulation film 105 covers the second surface 104*b* of the vibration plate 104, the surface of the driving element 102, and the wiring part 106*a* of the lower electrode 106. The insulation film 105 includes holes 105*b* that expose the connection terminal part 106*b* of the lower electrode 106.

The insulation film 105 is made of, for example, $SiO_2$. The insulation film 105 may be made of another material such as SiN (silicon nitride). The insulation film 105 has the uniform size on the second surface 104*b* of the vibration plate 104, the surface of the driving element 102, and the electrode part 106*c* of the lower electrode 106. The thickness of the insulation film 105 is 1 μm. The thickness of the insulation film 105 is preferably, in the range of 0.1 μm to μm, approximately. Note that the thickness of the insulation film 105 may be partially different.

As shown in FIGS. 3 and 4, the insulation film 105 includes contact parts 113. Each of the contact parts 113 is a hole 105*c* provided on part of the insulation film 105 on the outer surface 102*a* of the corresponding driving element 102. The contact part 113 has, for example, a circular shape whose diameter is 20 μm. The hole 105*b* partially exposes part of the electrode part 106*c* of the lower electrode 106, which does not come into contact with the piezoelectric film 111. In addition, the hole 105*c* partially exposes part of the electrode part 107*c*, which does not come into contact with the piezoelectric film 111. The hole 105*c* is provided closer to the outer periphery of the electrode part 107*c* rather than at the center between the inner periphery and the outer periphery of the electrode part 107*c* having an annular shape.

As shown in FIG. 4, the connection terminal part 107*b* of the upper electrode 107 and the wiring part 107*a* of the upper electrode 107 are arranged on the surface 105*a* of the insulation film 105. In other words, the connection terminal part 107*b* and the wiring part 107*a* are arranged on the insulation film 105. The surface 105*a* of the insulation film 105 faces the opposition direction of the vibration plate 104.

As shown in FIGS. 3 and 4, the wiring part 107*a* of the upper electrode 107 connects the electrode part 107*c* and the connection terminal part 107*b* of the corresponding driving element 102. The wiring part 107*a* extends in the shorter side direction (e.g., horizontal direction of FIG. 3) of the nozzle plate 100.

As shown in FIG. 2, the wiring parts 107*a* join together at near the center of the shorter-side direction (horizontal direction of FIG. 2) of the nozzle plate 100, and thereby forms part extending along the longer-side direction (vertical direction of FIG. 2) of the nozzle plate 100. As a result, the connection terminal part 107*b* and 8 electrode parts 107*c* are connected to each other by the wiring part 107*a*. On the other hand, the wiring parts 107*a*, which are connected to the driving elements 102 at the end of the shorter-side direction and pulled out to the end of the nozzle plate 100 at regular intervals, are each connected to the corresponding connection terminal part 107*b* and arranged so that the distance between the driving element 102 and the connection terminal part 107*b* decreases.

As shown in FIG. 4, the wiring part 107*a* of the upper electrode 107 arranged on the surface 105*a* of the insulation film 105, which covers the driving element 102. One end of the wiring part 107*a* is connected to the electrode part 107*c* of the upper electrode 107 through the contact part 113 (hole 105*c*). In other words, the contact part 113 is obtained by partially removing the insulation film 105 in order to connect the wiring part 107*a* to the electrode part 107*c*.

The insulation film 105 separates the wiring part 107*a* of the upper electrode 107 and the electrode part 106*c* of the lower electrode 106 from each other. The insulation film 105 prevents the lower electrode 106 and the upper electrode 107 from being electrically connected.

The protective film 108 is arranged on the second surface 104*b* of the vibration plate 104. The protective film 108 is made of photosensitive polyimide such as "Photoneece" (registered trademark) produced by Toray industries, Inc. In other words, the protective film 108 is made of an insulating material different from the insulation film 105. Alternatively, the protective film 108 may be made of another insulating material such as resin and ceramics. Resin such as a plastic material such as another kind of polyimide, ABS, polyacetal, polyamide, polycarbonate, and polyethersulfone is used. Ceramics such as nitride, carbide, and oxide such as zirconia, silicon carbide, silicon nitride, and barium titanate is used. In addition, the protective film 108 may be made of a metal material as long as it has insulation properties for the driving element 102 and the upper electrode 107. The metal material is, for example, aluminum, SUS, and titanium.

The material of the protective film 108 is selected in consideration of the heat resistance, insulation properties, thermal expansion coefficient, smoothness, and wettability with respect to ink. The insulation properties the material may affect the degree of change in the quality of ink when the driving elements 102 drive, in the case where the inkjet printer 1 uses ink having a high conductivity.

The protective film 108 covers the second surface 104*b* of the vibration plate 104, the surface 105*a* of the insulation film 105, and the wiring part 107*a* of the upper electrode 107. In other words, the protective film 108 covers the driving element 102 and the wiring part 106*a* of the lower electrode 106 from above the insulation film 105. The protective film 108 protects the driving element 102, the lower electrode 106, and the upper electrode 107 from, for example, ink and water in air. The protective film 108 includes holes exposing the connection terminal parts 106*b* and 107*b* of the lower electrodes 106 and 107, respectively.

The Young's modulus of the material of the protective film 108 is different from the Young's modulus of the material of the vibration plate 104. The vibration plate 104 is made of $SiO_2$, the Young's modulus thereof being 80.6 GPa. On the other hand, the protective film 108 is made of polyimide, the Young's modulus thereof being 4 GPa. In other words, the Young's modulus of the protective film 108 is smaller than the Young's modulus of the vibration plate 104.

The surface 108*a* of the protective film 108 has a substantially smooth shape, but has a minute concavity and convexity. For example, part of the surface 108*a* of the protective film 108, on which the driving element 102 is provided, protrudes than the other part. The surface 108*a* of the protective film 108 is opposite to the surface fixed to the vibration plate 104.

The thickness of the protective film 108 is 4 μm, approximately, excluding the part of the protective film 108 on which the driving element 102, the lower electrode 106, and the upper electrode 107 are arranged. The film thickness of the protective film 108 is in the range of 1 to 50 μm, approximately. The thickness of the protective film 108 is the distance from the second surface 104*b* of the vibration plate 104 to the surface 108*a* of the protective film 108. The thickness of the protective film 108 formed on the driving element 102 is 2.5 μm, approximately. This thickness of the protective film 108 is the distance from the surface 105*a* of the insulation film 105 arranged on the driving element 102 to the surface 108*a* of the protective film 108.

The ink-repellent film 109 covers the protective film 108 and part of the insulation film 105. The ink-repellent film 109 is made of silicon-series liquid-repellent material having liquid repellency or fluorinated organic material, such as "Cytop" (registered trademark) produced by Asahi Glass Co. Ltd. Note that the ink-repellent film 109 may be made of another material.

The ink-repellent film 109 does not cover but exposes the protective film 108 around the connection terminal part 106*b* of the lower electrode 106 and the connection terminal part 107*b* of the upper electrode 107. The surface 109*a* of the ink-repellent film 109 constitutes the surface of the nozzle plate 100. The surface 109*a* of the ink-repellent film 109 is opposite to the surface fixed to the protective film 108.

The thickness of the ink-repellent film 109 is, for example, 1 μm, excluding the part of the ink-repellent film 109 on which the driving elements 102, the upper electrode 107, and the lower electrode 106 are arranged. The thickness of the ink-repellent film 109 is preferably, for example, in the range of 0.01 μm to 10 μm. The thickness of part of the ink-repellent film 109, on which the driving element 102 is provided, is smaller than the other part. Note that the thickness of the ink-repellent film 109 may be constant.

Ink drops attached to the vicinity of the nozzle 101 may reduce the stability of ink ejection, the ink drops being ejected by the nozzle 101. The ink-repellent film 109 prevents ink drops from being attached to the surface of the nozzle plate 100.

The nozzle 101 penetrates through the vibration plate 104, the protective film 108, and the ink-repellent film 109. In other words, the nozzle 101 is formed on the vibration plate 104, the protective film 108, and the ink-repellent film 109. The vibration plate 104 and the protective film 108 are each ink-philic (lyophilic), and thereby the meniscus of ink stored in the pressure cells 201 is kept in the nozzle 101. Part of the protective film 108 is interposed between the nozzle 101 and the peripheral surface of the driving element 102.

A controller (not shown) is connected to the connection terminal part 106*b* of the lower electrode 106 via, for example, a flexible cable. The controller is, for example, an IC that controls the inkjet head 21 or a microcomputer that controls the inkjet printer 1. On the other hand, the connection terminal part 107*b* of the upper electrode 107 is connected to, for example, GND (grounded=0V).

The controller transmits signals for driving the corresponding driving element 102 to the lower electrode 106. The lower electrode 106 is used as an individual electrode that drives the driving elements 102 independently.

The inkjet head 21 performs printing (forms images) as follows, for example. In response to an operation from a user, a print instruction signal is input in a controller. In response to the printing instruction, the controller applies the signal to the driving elements 102. In other words, the controller applies drive voltage to the electrode part 106*c* of the lower electrode 106.

When the signal (drive voltage) is applied to the electrode part 106*c* of the lower electrode 106, a difference in potential is generated between the electrode part 106*c* of the lower electrode 106 and the electrode part 107*c* of the upper electrode 107. As a result, the electric field in the thickness direction of the piezoelectric film 111 is applied to the piezoelectric film 111, and the piezoelectric film 111 thereby contracts. Specifically, the piezoelectric film 111 expands or contracts in its thickness direction (electric field direction), and contracts or expands in the in-plane direction (direction perpendicular to the electric field direction), at the same time. Similarly, the driving element 102 including the piezoelectric film 111 expands or contracts in the thickness direction of the piezoelectric film 111, and contracts or expands in the in-plane direction of the piezoelectric film 111, at the same time. In the following description, expansion and contraction of the driving element 102 (piezoelectric film 111) only in the in-plane direction will be described, and expansion and contraction of the driving element 102 (piezoelectric film 111) in the thickness direction will not be described.

In the nozzle plate 100, the driving element 102 expands in the in-plane direction, and thereby deforms (bends) so that the volume of the pressure cell 201 is decreased. As a result, when the driving element 102 expands in the in-plane direction, the vibration plate 104, which is connected to the driving element 102, deforms (bends) so that the volume of the pressure cell 201 is decreased. In addition, the driving element 102 contracts in the in-plane direction, and thereby deforms (bends) so that the volume of the pressure cell 201 is increased. As a result, when the driving element 102 contracts in the in-plane direction, the vibration plate 104, which is connected to the driving element 102, bends so that the volume of the pressure cell 201 is increased. At this time, the insulation film 105 and the protective film 108 inhibits the bending of the vibration plate 104.

In more detailed description, as shown in FIGS. 3 and 4, the driving element 102 is sandwiched between the vibration plate 104, the insulation film 105, and the protective film 108. With this structure, when the driving element 102 expands in the in-plane direction (direction perpendicular to the electric field direction) of the piezoelectric film 111, a force is applied to the vibration plate 104, and the vibration plate 104 deforms in concave shape in the direction toward the pressure cell 201 side. In other words, the vibration plate 104 intends to bend in the direction in which the volume of the pressure cell 201 is increased. To the contrary, a force is applied to the insulation film 105 and the protective film 108, and the insulation film 105 and the protective film 108 deform in a convex shape in the direction toward the pressure cell 201 side. In other words, the insulation film 105 and the protective film 108 intend to bend in the direction in which the volume of the pressure cell 201 is decreased.

On the other hand, when the driving element 102 contracts in the in-plane direction (direction perpendicular to the electric field direction) of the piezoelectric film 111, a force is applied to the vibration plate 104, and the vibration plate 104 deforms in a convex shape in the direction toward the pressure cell 201 side. In other words, the vibration plate 104 intends to bend in the direction in which the volume of the pressure cell 201 is decreased. In addition, a force is applied to the insulation film 105 and the protective film 108, and the insulation film 105 and the protective film 108 deform in a concave shape in the direction toward the pressure cell 201 side. In other words, the insulation film 105 and the protective film 108 intend to bend in the direction in which the volume of the pressure cell 201 is increased.

As described above, the vibration plate 104, and the insulation film 105 and the protective film 108 intend to bend in a direction opposite to each other. Specifically, the insulator formed by the insulation film 105 and the protective film 108 generates a force (film stress) that inhibits the deforming of the vibration plate 104 by the driving element 102.

The deformation amount of a member is affected by the Young's modulus and the thickness of the member. The Young's modulus of polyimide, which forms the protective film 108, is smaller than the Young's modulus of $SiO_2$, which forms the vibration plate 104. Because of this, when the same amount of force is applied to the protective film 108 and the vibration plate 104, the protective film 108 deforms larger than the vibration plate 104. Further, the insulation film 105 is thinner than the vibration plate 104. Because of this, when the same amount of force is applied to the insulation film 105 and the vibration plate 104, the insulation film 105 deforms larger than the vibration plate 104.

As described above, the driving element 102 works in the bending mode (bending vibration). When voltage is applied to the driving element 102, the vibration plate 104 deforms because of the driving element 102, and the volume of the pressure cell 201 is thereby changed.

First, the driving element 102 causes the vibration plate 104 to deform, and the volume of the pressure cell 201 is thereby increased. As a result, negative pressure is generated on the ink stored in the pressure cell 201, and the ink flows from the ink flow path 401 into the pressure cell 201.

Next, the driving element 102 causes the vibration plate 104 to deform, and the volume of the pressure cell 201 is thereby decreased. As a result, the ink in the pressure cell 201 is pressurized (positive pressure is generated on the ink). The positive pressure applied to the ink does not escape to the ink flow path 401 and is kept in the pressure cell 201. As a result, the pressurized ink is ejected from the nozzle 101.

The larger the difference between the Young's modulus of the vibration plate 104 and the Young's modulus of the protective film 108, the lower the voltage of the ink ejection, thereby causing the inkjet head 21 to eject ink effectively. Further, the larger the difference between the thickness of the insulator formed of the insulation film 105 and the protective film 108 and the thickness of the vibration plate 104, the lower the voltage of the ink ejection, thereby causing the inkjet head 21 to eject ink effectively.

Next, an example of a method of manufacturing the inkjet head 21 will be described. First, before forming the pressure cells 201, an $SiO_2$ film is formed as the vibration plate 104 on the entire area of the first surface 200*a* of the pressure cell structure 200 (silicon wafer). The $SiO_2$ film is formed by a thermally-oxidized film-forming method, for example. Note that the $SiO_2$ film may be formed by using another method such as a CVD method.

A silicon wafer, from which the pressure cell structure 200 is formed, is one large circular plate.

The pressure cell structures 200 are cut out from the silicon wafer later. Alternatively, one pressure cell structure 200 may be formed from one rectangular silicon wafer.

The silicon wafer is repeatedly heated and thin films are formed when the inkjet head 21 is manufactured. In view of this, the silicon wafer is heat-resistant, complies with SEMI (Semiconductor Equipment and Materials international) standard, and is mirror-polished and smoothed.

Next, a metal film as the lower electrode 106 is formed on the second surface 104*b* of the vibration plate 104. First, Ti and Pt are sputtered, and Ti and Pt films are formed in order. The film thickness of Pt is, for example, 0.45 μm. The film thickness of Ti is, for example, 0.05 μm. Note that the metal films may be formed by another method such as vapor deposition and metal plating.

Next, the piezoelectric film 111 is formed on the metal film as the lower electrode 106. The piezoelectric film 111 is formed by, for example, an RF magnetron sputtering method. At this time, the temperature of the silicon wafer is, for example, 350° C. After the piezoelectric film 111 is formed, the piezoelectric film 111 is heated at 650° C. for 3 hours in order to apply piezoelectricity. As a result, the piezoelectric film 111 obtains good crystallinity and good piezoelectricity, at the same time. The piezoelectric film 111 may be formed by another method such as CVD (chemical vapor deposition), a sol-gel method, an AD method (aerosol deposition method), and a hydrothermal synthesis method.

Next, a metal film of Pt as the electrode part 107*c* of the upper electrode 107 is formed on the piezoelectric film 111. The metal film is formed by a sputtering method. The metal film may be formed by another method such as vacuum vapor deposition and metal plating.

Next, the metal film and the piezoelectric film 111 are etched, and the electrode part 107*c* of the upper electrode 107 and the piezoelectric film 111 are patterned. An etching mask is formed on the metal film, the metal film and the piezoelectric film 111 uncovered by the etching mask are etched and removed, and the electrode part 107*c* of the upper electrode 107 and the piezoelectric film 111 are thereby patterned. The metal film and the piezoelectric film 111 are patterned at the same time. Note that the metal film and the piezoelectric film 111 may be patterned individually. The etching mask is formed as follows. The metal film is coated with a photosensitive resist, then prebaked, exposed with light where it is covered with a mask on which a desired pattern is formed, developed, and postbaked.

Next, the lower electrode 106 is formed by patterning. An etching mask is formed on the piezoelectric film 111, the electrode part 107*c* of the upper electrode 107, and the metal film (Pt/Ti) under the piezoelectric film 111, part of the metal film uncovered by the etching mask is etched and removed, and the lower electrode 106 is thereby patterned. The etching mask is formed as follows. The piezoelectric film 111, the electrode part 107*c* of the upper electrode 107, and the metal film (Pt/Ti) under the piezoelectric film 111 are coated with a photosensitive resist, then prebaked, exposed with light where it is covered with a mask on which a desired pattern is formed, developed, and postbaked.

The nozzle 101 is formed at the center of the piezoelectric film 111 and the electrode parts 106*c* and 107*c* of the lower electrode 106 and the upper electrode 107. With this structure, a portion without the metal film and the piezoelectric film 111 is formed, the portion and the electrode parts 106*c* and 107*c* and the piezoelectric film 111 being concentric, the center of the portion and the center of the electrode parts 106*c* and 107*c* and the piezoelectric film 111 being the same. In this way, the driving element 102 is formed on the second surface 104*b* of the vibration plate 104. By the patterning, the vibration plate 104 is exposed except for the wiring part 106*a* of the lower electrode 106, the electrode part 106*c* of the lower electrode 106, and the driving element 102.

Next, the insulation film 105 is formed on the second surface 104*b* of the vibration plate 104 and the driving element 102. The insulation film 105 is formed by the CVD method, which realizes good insulation properties at a low temperature. Alternatively, the insulation film 105 may be formed by another method such as a sputtering method and vapor deposition.

After the insulation film 105 is formed, the insulation film 105 is patterned. Because the nozzle 101 is formed, a portion without the insulation film 105 is formed, the portion and the driving element 102 being concentric, the center of the portion and the center of the driving element 102 being the same. At the same time, the contact part 113 is formed. The diameter of the portion without the insulation film 105 is, for example, 10 μm. The insulation film 105 uncovered by the etching mask is etched and removed, and the insulation film 105 is thereby patterned. The etching mask is formed as follows. The insulation film 105 is coated with a photosensitive resist, then prebaked, exposed with light where it is covered with a mask on which a desired pattern is formed, developed, fixed, and postbaked.

Next, a metal film as the wiring part 106*a* and the connection terminal parts 106*b* of the lower electrode 106 and the wiring parts 107*a* and the connection terminal part 107*b* of the upper electrode 107 is formed on the insulation film 105. The metal film is a Ti (titanium)/Al (aluminum) thin film formed by, for example, a sputtering method. The film thickness of Ti is, for example, 0.1 μm. The film thickness of Al is, for example, 0.4 μm. The metal film may be formed by another method such as vacuum vapor deposition and metal plating. The metal film is connected to any one of the electrode part 106*c* of the lower electrode 106 and the electrode part 107*c* of the upper electrode 107 through the contact part 113.

By patterning the metal film, the wiring part 106*a* and the connection terminal part 106*b* of the lower electrode 106 and the wiring part 107*a* and the connection terminal part 107*b* of the upper electrode 107 are formed. An etching mask is formed on the metal film, the metal film uncovered by the etching mask is etched and removed, and the metal film is thereby patterned. The etching mask is formed as follows. The metal film is coated with a photosensitive resist, then prebaked, exposed with light where it is covered with a mask on which a desired pattern is formed, developed, and postbaked.

Next, an $SiO_2$ film as the vibration plate 104 is patterned, and part of the nozzle 101 is formed. An etching mask is formed on the $SiO_2$ film, the $SiO_2$ film uncovered by the etching mask is etched and removed, and the $SiO_2$ film is thereby patterned. The etching mask is formed as follows. The vibration plate 104 is coated with a photosensitive resist, then prebaked, exposed with light where it is covered with a mask on which a desired pattern is formed, developed, and postbaked.

Next, the protective film 108 is formed on the vibration plate 104, the insulation film 105, the wiring part 106*a* and the connection terminal part 106*b* of the lower electrode 106, and the wiring part 107*a* and the connection terminal part 107*b* of the upper electrode 107 by a spin coating method (spin coating). In other words, the protective film 108 that covers the insulation film 105 is formed. First, polyimide precursor-containing solution covers the second surface 104*b* of the vibration plate 104 and the insulation film 105. Next, the silicon wafer is rotated, and the surface of the solution is thereby smoothed. The solution is baked for thermal polymerization, and removed, and the protective film 108 is thereby formed.

The protective film 108 may not be formed by spin coating. The protective film 108 may be formed by another method such as CVD, vacuum vapor deposition, and metal plating.

By patterning the protective film 108, the nozzle 101 is formed and the connection terminal part 106*b* of the lower electrode 106 and the connection terminal part 107*b* of the upper electrode 107 are exposed. The protective film 108 is patterned in the procedure depending on the material of the protective film 108.

The case where the protective film 108 is formed of non-photosensitive polyimide such as "Semicofine" (registered trademark) produced by Toray industries, Inc. will be described. First, polyimide precursor-containing solution is spin coated to form a film. The solution is baked for thermal polymerization, removed, and thereby burned and formed. After that, an etching mask is formed on the non-photosensitive polyimide film, part of the non-photosensitive polyimide film uncovered by the etching mask is etched and removed, and the non-photosensitive polyimide film is thereby patterned. The etching mask is formed as follows. The non-photosensitive polyimide film is coated with a photosensitive resist, then prebaked, exposed with light, where it is covered with a mask on which a desired pattern is formed, developed, and postbaked.

The case where the protective film 108 is made of photosensitive polyimide such as "Photoneece" (registered trademark) produced by Toray industries, Inc. will be described. First, solution is spin coated to form a film. After that, the solution is prebaked. After that, the solution is patterned after exposure with a mask and a developing process. In the case of positive photosensitive polyimide, portions of the mask, which correspond to the nozzle 101, the opening (not shown), the connection terminal part 106*b* of the lower electrode 106, and the connection terminal part 107*b* of the upper electrode 107, are opened (light transmits through the portions). In the case of negative photosensitive polyimide, the mask shields portions of the mask, which correspond to the nozzle 101, the opening (not shown), the connection terminal part 106*b* of the lower electrode 106, and the connection terminal part 107*b* of the upper electrode 107, from light. After that, the resulting object is postbaked and burned, and the protective film 108 is thereby formed.

Next, a cover tape is adhered to the protective film 108. The cover tape is, for example, a back-side protective tape for chemical mechanical polishing (CMP) for a silicon wafer. The pressure cell structure 200 with the cover tape is turned upside down, and the pressure cells 201 are formed through the pressure cell structure 200. The pressure cells 201 are formed by patterning.

FIGS. 3 and 4 are each a sectional view showing the inkjet head according to this embodiment, on which an insulating protective film is formed. The pressure cell structure 200 is etched by using a vertical deep dry etching dedicated to silicon substrates, which is called as Deep-RIE (see, for example, WO2003/030239), and the pressure cells 201 are thereby formed. At this time, a resist mask on which a desired pattern is formed is formed on the pressure cell structure 200 being a silicon wafer. With this structure, the pressure cells 201 are formed in a desired pattern. The resist mask is formed as follows. The pressure cell structure 200 is coated with a photosensitive resist, then prebaked, exposed with light where it is covered with a mask on which a desired pattern is formed, developed, and postbaked.

$SF_6$ gas is used for this etching. The $SiO_2$ film of the vibration plate 104 and the polyimide film of the protective film 108 are not etched when $SF_6$ gas is used. Because of this, the silicon wafer, which forms the pressure cells 201, is dry etched, but the vibration plate 104 and the other members are not dry etched. In other words, the vibration plate 104 functions as an etching stop layer.

Note that instead of that etching, any one of various methods may be used such as wet etching in which chemical solution is used and dry etching in which plasma is used. The etching methods and the etching conditions may be changed depending on the material.

As described above, steps from the step of forming the driving element 102 and the nozzle 101 on the vibration plate 104 to the step of forming the pressure cells 201 in the pressure cell structure 200 are performed by using film-forming techniques, photolithography etching techniques, and a spin coating method. Because of this, the nozzle 101, the driving element 102, and the pressure cell 201 are formed in a silicon wafer accurately and easily.

Next, the ink flow path structure 400 is bonded to the second surface 200*b* of the pressure cell structure 200. Specifically, the ink flow path structure 400 is bonded to the pressure cell structure 200 with epoxy-based adhesive.

Next, a cover tape is adhered to part of the protective film 108, and the cover tape thereby covers the connection terminal part 106*b* of the lower electrode 106 and the connection terminal part 107*b* of the upper electrode 107. The cover tape is made of resin, and the cover tape can thereby be removed from the protective film 108 easily. Thanks to the cover tape, dusts and the ink-repellent film 109 less attach to the connection terminal part 106*b* of the lower electrode 106 and the connection terminal part 107*b* of the upper electrode 107.

Next, the ink-repellent film 109 is formed on the protective film 108. A liquid ink-repellent film material is spin coated on the protective film 108, and the ink-repellent film 109 is thereby formed. At this time, positive pressure air is injected into the ink inlet port. As a result, positive pressure air is discharged from the nozzle 101 in communication with the ink flow path 401. When the liquid ink-repellent film material is coated on the protective film 108 in this situation, the ink-repellent film material less attaches to the inner wall of the nozzle 101. After the ink-repellent film 109 is formed, the cover tape is peeled from the protective film 108.

Next, the silicon wafer is divided, and the inkjet heads 21 are thereby formed. The inkjet head 21 is mounted in the inkjet printer 1. A controller is connected to the connection terminal part 106*b* of the lower electrode 106 via, for example, a flexible cable. Further, the ink inlet port and the ink outlet port of the ink flow path structure 400 are connected to the ink tank via, for example, a tube.

As described above, in this embodiment, the nozzle plate 100 is formed on the pressure cell structure 200. However, instead of forming the nozzle plate 100 on the pressure cell structure 200, part of the pressure cell structure 200 may be used as the vibration plate 104. For example, the driving element 102 is formed on one surface of the pressure cell structure 200, and a hole corresponding to the pressure cell 201 is formed on the other surface of the pressure cell structure 200. The hole does not penetrate through the pressure cell structure 200. The forming of the hole leaves a thin layer on the one surface of the pressure cell structure 200, and the thin layer serves as the vibration plate 104.

Next, with reference to FIG. 2, the operation and effect of the structure according to this embodiment will be described. The inkjet head 21 of the inkjet printer 1 of this embodiment includes the nozzle plate 100 on which the nozzles 101 are formed, and the driving elements 102 (actuators) corresponding to the individual nozzles 101 one to one. The nozzle plate 100 includes the electrode parts 107*c* (electrode parts of common electrodes), which are connected to the driving elements 102 and apply voltage to the driving elements 102, and the electrode part 106*c* (electrode part of an individual electrode) for applying voltage to the corresponding driving element 102. Further, the parallel arrangement parts 106*f* are provided at the end of the nozzle plate 100 (e.g., end on the left side of FIG. 2). The parallel arrangement parts 106*f* are arranged along the longer-side direction of the vibration plate 104 (longer-side direction of the nozzle plate 100). Each of the parallel arrangement part 106*f* includes the connection terminal parts 106*b* being the connection terminals of the individual electrodes. Each of the connection terminal parts 106*b* is connected to the electrode part 106*c* of the lower electrode 106. The connection terminal parts 106*b* are arranged in the parallel arrangement part 106*f* along the longer-side direction of the vibration plate 104 (longer-side direction of the nozzle plate 100). The connection terminal part 107*b* is located between the connection terminal parts 106*b*. The connection terminal part 107*b* is arranged outside of the parallel arrangement part 106*f*. The connection terminal part 107*b* is located between the parallel arrangement parts 106*f*. The connection terminal part 107*b* is located at both ends of the parallel arrangement part 106*f*. According to this structure, the connection terminal parts 107*b* of the upper electrode 107 can be pulled out to the end of the nozzle plate 100 with high frequency. As a result, the distance between the electrode part 107*c* and the connection terminal part 107*b* in the driving element 102 can be decreased as compared with the case where the connection terminal part 107*b*, which is the connection terminal of the electrode part 107*c* and the external element for applying voltage, is arranged only at the end of the head body. According to this structure, the distance between the driving element 102 and the connection terminal part 107*b* of the electrode part 107*c* can be decreased. As a result, the voltage changes caused due to wiring resistance can be reduced. Further, the difference between the maximum distance and the minimum distance between the electrode part 107*c* and the connection terminal part 107*b* in the driving element 102 can be decreased. As a result, the difference between voltage changes in the driving elements 102 is decreased, and the stability of the driving of each driving element 102 can be thereby maintained. In addition, because the connection terminal parts 107*b* are provided with high frequency, current concentration can be avoided and the reduction in yield due to short-circuiting, wiring damage, or the like, can be suppressed.

In addition, in this embodiment, the driving elements 102 (actuators) are divided into groups, and the electrode parts 106*c* of the lower electrodes 106 (individual electrodes) and the electrode part 107*c* of the upper electrode 107 (common electrode) are arranged for each group. As shown in FIG. 2, the wiring part 107*a* of the upper electrode 107 is arranged at the substantially central position of each driving element 102 with 8 driving elements 102 as one group, herein. The wiring part 106*a* of the lower electrode 106 extends in the direction perpendicular to the direction in which the wiring parts 107*a* are arranged. Note that the wiring parts 106*a* of the lower electrode 106 are arranged at both ends of the driving elements 102 for each group in the direction in which the parallel arrangement parts 106*f* of the connection terminal part 106*b* of the lower electrode 106 are arranged. Further, the wiring parts 106*a* of the lower electrode 106 are arranged between one line of driving elements 102 and the next line of driving elements 102, the lines being adjacent to each other in the longer-side direction of the nozzle plate 100, and is pulled out to the connection terminal parts 106*b*. According to this structure, the driving elements 102 in each group can be regularly formed to have the same shape, and the method of manufacturing the inkjet heads 21 can be made easy.

Note that the number of driving elements 102 in one group does not necessarily need to be the same and the number of driving elements in each group may be changed although the example in which all of the groups have the same number of driving elements 102 with 8 driving elements 102 as one group has been described in this embodiment. Also in this case, the difference between the maximum distance and the minimum distance between the electrode part 107*c* and the connection terminal part 107*b* in the driving element 102 can be decreased. As a result, by forming the connection terminal parts 107*b* of the electrode part 107*c* with high frequency, the maximum distance between the connection terminal parts 107*b* of the electrode part 107*c* and the driving elements 102 can be decreased and the difference between the maximum distance and the minimum distance can be reduced, at the same time. The driving element 102 is thereby less affected.

According to this embodiment, it is possible to decrease the maximum distance between the connection terminal of the common electrode and the driving element (actuator), and to provide an inkjet head and an inkjet recording apparatus having high stability obtained by driving each driving element stably.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head, comprising:

a nozzle plate with a plurality of nozzles for ejecting ink;

actuators arranged on the nozzle plate, the actuators corresponding to the nozzles one to one;

individual electrodes on the nozzle plate, each of the individual electrodes being electrically connected to a corresponding one of the actuators and including a connection terminal connectable to an external element; and a common electrode on the nozzle plate and electrically connected to each of the actuators, the common electrode including a wiring, which connects adjacent actuators, and a connection terminal connectable to the external element, the connection terminal of the common electrode being between the connection terminals of the individual electrodes.

2. The inkjet head according to claim 1, wherein the actuators are divided into groups, the individual electrodes and the common electrode are provided for each of the groups, and a parallel arrangement part is provided at an end of the nozzle plate for each of the groups, the parallel arrangement part including the connection terminals of the individual electrodes arranged in parallel with each other.

3. The inkjet head according to claim 2, wherein the connection terminal of the common electrode is provided outside of the parallel arrangement part.

4. The inkjet head according to claim 3, wherein each of the individual electrodes includes an electrode part connected to the corresponding actuator, and a wiring part that connects the connection terminal of the individual electrode and the electrode part to each other, and the wiring part is arranged between the actuators and is pulled out to the connection terminal of the individual electrode.

5. The inkjet head according to claim 2, wherein each of the groups has a same number of individual electrodes.

6. The inkjet head according to claim 4, wherein the wiring parts of the individual electrodes for one group of the actuators are provided at both the sides of the one group of the actuators in an arrangement direction, the connection terminals of the individual electrodes being arranged in the parallel arrangement part in the arrangement direction.

7. An inkjet recording apparatus, comprising:

a conveyer apparatus that conveys recording paper; and an inkjet head that ejects ink on the recording paper conveyed by the conveyer apparatus to form an image, wherein the inkjet head includes:

a nozzle plate with a plurality of nozzles for ejecting ink, a plurality of actuators arranged on the nozzle plate, the actuators corresponding to the nozzles one to one, individual electrodes on the nozzle plate, each of the individual electrodes being connected to a corresponding one of the actuators in the plurality of actuators and including a connection terminal connectable to an external element, and a common electrode on the nozzle plate and connected to the plurality of actuators, the common electrode including a wiring, which connects adjacent actuators in the plurality, and a connection terminal connectable to the external element, the connection terminal of the common electrode being between the connection terminals of the individual electrodes.

8. The inkjet recording apparatus according to claim 7, wherein the actuators are divided into groups, the individual electrodes and the common electrode are provided for each of the groups, and a parallel arrangement part is provided at an end of the nozzle plate for each of the groups, the parallel arrangement part including the connection terminals of the individual electrodes arranged in parallel with each other.

9. The inkjet recording apparatus according to claim 8, wherein the connection terminal of the common electrode is provided outside of the parallel arrangement part.

10. The inkjet recording apparatus according to claim 9, wherein each of the individual electrodes includes an electrode part connected to the corresponding actuator, and a wiring part that connects the connection terminal of the individual electrode and the electrode part to each other, and the wiring part is arranged between the actuators and extends to the connection terminal of the individual electrode.

11. An inkjet head, comprising:

a plurality of nozzles configured to eject ink;

a nozzle plate having the plurality of nozzles arranged in a first direction and in a second direction perpendicular to the first direction;

actuators arranged on the nozzle plate to correspond with each of the nozzles, the actuators including first actuators which are arrayed in the first direction and second actuators which are arranged next to the first actuators in the second direction and are arrayed in the first direction;

a plurality of first individual electrodes arranged on the nozzle plate and configured to apply voltage to each of the first actuators, each of the first individual electrodes including a first connection terminal connectable to an external element;

a plurality of second individual electrodes arranged on the nozzle plate and configured to apply voltage to each of the second actuators, each of the second individual electrodes including a second connection terminal connectable to the external element;

a first common electrode arranged on the nozzle plate and configured to apply voltage to the first actuators, the first common electrode including a wiring which connects two adjacent actuators of the first actuators and a third connection terminal which is arranged next to the first connection terminal and is connectable to the external element; and a second common electrode arranged on the nozzle plate and configured to apply voltage to the second actuators, the second common electrode including a wiring which connects two adjacent actuators of the second actuators and a fourth connection terminal which is arranged next to the second connection terminal and is connectable to the external element.

12. The inkjet head according to claim 11, wherein the first common electrode connects two adjacent actuators of the first actuators in a shortest distance, and the second common electrode connects two adjacent actuators of the second actuators in a shortest distance.

13. The inkjet head according to claim 12, wherein the first connection terminals and the second connection terminals are provided on an end portion of the nozzle plate located in the first direction relative to the individual electrodes.

14. The inkjet head according to claim 13, wherein the first connection terminals are located on opposite sides of the third connection terminal in the second direction, and the second connection terminals are located on opposite sides of the fourth connection terminal in the second direction.

15. The inkjet head according to claim 14, further comprising a third common electrode arranged on an end area of the nozzle plate in the second direction relative to the nozzles, the third common electrode including a fifth connection terminal, which is connectable to the external element, and connecting to the first common electrode and the second common electrode.

* * * * *